US005305211A

United States Patent [19]

Soliman

[11] Patent Number: 5,305,211

[45] Date of Patent: Apr. 19, 1994

[54] METHOD FOR DETERMINING FLUID-LOSS COEFFICIENT AND SPURT-LOSS

[75] Inventor: Mohamed Y. Soliman, Lawton, Okla.

[73] Assignee: Halliburton Company, Houston, Tex.

[21] Appl. No.: 737,615

[22] Filed: Jul. 30, 1991

Related U.S. Application Data

[63] Continuation-in-part of Ser. No. 585,439, Sep. 20, 1990, abandoned.

[51] Int. Cl.[5] ..... G06F 15/20; E21B 49/08

[52] U.S. Cl. ..... 364/422; 166/250

[58] Field of Search ..... 166/250; 364/422

[56] References Cited

U.S. PATENT DOCUMENTS

| | | | |
|---|---|---|---|
| 4,749,038 | 6/1988 | Shelley | 166/250 |
| 4,836,280 | 6/1986 | Soliman | 166/250 |
| 4,848,461 | 7/1989 | Lee | 166/250 |
| 5,005,643 | 4/1991 | Soliman et al. | 166/250 |
| 5,050,674 | 9/1991 | Soliman et al. | 166/250 |

OTHER PUBLICATIONS

"Boeing Graph User's Guide Version 4", Sep. 1987, pp. 103–128.

"Representation, Manipulation and Display of 3-D Discrete Objects", Tuy Proceedings of the 16th Annual Hawaii Int'l Conf. Sys. Sci. 1983, pp. 397–406.

"A General Analysis of Fracturing Pressure Decline With Application To Three Models" by K. G. Nolte.

*Primary Examiner*—Gail O. Hayes

*Attorney, Agent, or Firm*—Tracy W. Druce; Michael Lynch

[57] ABSTRACT

A method for determining fracture parameters of heterogenous or homogeneous formations which takes into account spurt-loss is provided. The invention provides a method of determining fluid-loss coefficient, spurt-loss and closure pressure based on a general minifrac analysis.

8 Claims, 3 Drawing Sheets

METHOD FOR DETERMINING FLUID-LOSS COEFFICIENT AND SPURT-LOSS

CROSS REFERENCE

The present application is a continuation-in-part of U.S. Application, Ser. No. 585,439, filed Sep. 20, 1990, now abandoned.

BACKGROUND OF THE INVENTION

1. Field of the Invention

The present invention relates generally to improved methods for determining fracture parameters of subterranean formations, and more specifically relates to improved methods for determining fluid-loss coefficient, spurt-loss and closure pressure for such formations.

2. Description of the Related Art

It is common in the industry to hydraulically fracture a subterranean oil-bearing formation in order to increase oil production. The success of a hydraulic fracturing treatment often hinges on being able to reasonably estimate the rate at which fluid leaks off from the fracture into adjacent permeable formations. An overestimate of fluid-loss rate can result in the use of excessive pad volumes, leading to increased treatment costs and increased potential for formation damage. More importantly, an underestimate can result in the use of insufficient pad volumes or insufficient fluid-loss control additives, resulting in premature treatment screen-out.

An indirect measurement of the effective fluid-loss coefficient is provided by the "minifrac" or the "minifracture" analysis which is well known in the art. Minifracturing was developed as a pretreatment technique for gaining information on fracture growth behavior. Since its inception, various expansions, modifications, and refinements have increased the applicability of the minifrac analysis. By using the minifrac analysis to analyze the pressure decline during the shut-in period following the creation of a small test fracture, or even a full-scale fracture, parameters such as fracture width and length, fluid efficiency, and closure time may be determined. Of the parameters that may be determined from the minifrac analysis, the most useful, at least for design purposes, has been the effective fluid-loss coefficient. The effective fluid-loss coefficient provided by minifrac analyses has usually provided more reliable estimates of fluid-loss rates and volumes than can be obtained through theoretical calculations based on fluid and formation properties and laboratory measurements of filter cake resistance.

Despite the increased reliability typically associated with fluid-loss coefficients obtained from minifrac tests, the insufficiency of conventional test techniques for naturally fractured formations is becoming known in the art. It is known that these techniques fail to adequately predict formation behavior. For example, sand-out cases have occurred that the conventional analysis and design techniques could not predict.

An attempt was made to solve this problem empirically by developing a correlation based on numerous field cases. Although the correlation has been applied successfully, its use may be limited to the formations for which it was developed. Similar correlations will have to be developed for various naturally fractured reservoirs.

Further, conventional minifrac analyses (see, e.g., U.S. Pat. No. 4,749,038) do not properly address spurt-loss. Spurt-loss is an initial brief period of rapid fluid-loss that has been observed in laboratory experiments. Because of its brevity, it is commonly characterized as an apparent positive intercept on plots of fluid-loss volume versus square root of time plots.

Most minifrac analysis techniques ignore the effect of spurt-loss. The only attempt to consider the effect of spurt-loss was presented by Nolte. Nolte, K.G., "*A General Analysis of Fracturing Pressure Decline With Application To Three Models,* SPE Formation Evaluation, December, 1986, pages 571–83. Nolte utilized a term $\kappa$ to account for increased fluid-loss during pumping due to spurt-loss. However, no technique to calculate this factor from pressure decline data was proposed.

The present invention is directed to an improved method of determining the fluid-loss or leakoff coefficient and the spurt-loss of a subterranean formation using a general minifrac analysis.

Accordingly, the present invention provides a new method for determining the spurt-loss and leakoff coefficient of a subterranean formation.

SUMMARY OF THE INVENTION

The present invention provides methods for accurately determining the fluid-loss coefficient, the spurt-loss and closure pressure of heterogenous or homogeneous formations. The present invention comprises the steps of calculating a leakoff exponent, n, that characterizes a rate at which fluid leaks off into the formation; determining a match pressure, P*, based on type curve matching; determining an observed fracture closure time, $t_c$, from field data; determining a spurt-loss volume per unit area, $S_p$, and fluid-loss coefficient, $C_{eff}$, and fracture closure pressure, $P_c$, from fracture formation equations.

Another embodiment of the invention comprises the steps of calculating a leakoff exponent, n, that characterizes a rate at which fluid leaks off into the formation; determining a match pressure, P*, based on type curve matching; determining an observed fracture closure time, $t_c$, from field data; solving a set of formation equations for several values of spurt-loss and several values of fluid-loss coefficient for fracture dimensions and closure time; graphically plotting fluid-loss coefficient and fracture dimension; plotting the values of spurt-loss; graphically plotting points of intersection as fluid-loss coefficient versus calculated closure time, and spurt-loss volume versus calculated closure time; determining the fluid-loss coefficient and the spurt-loss as a function of the observed closure time determined.

DETAILED DESCRIPTION OF A PREFERRED EMBODIMENT

Figure 2:
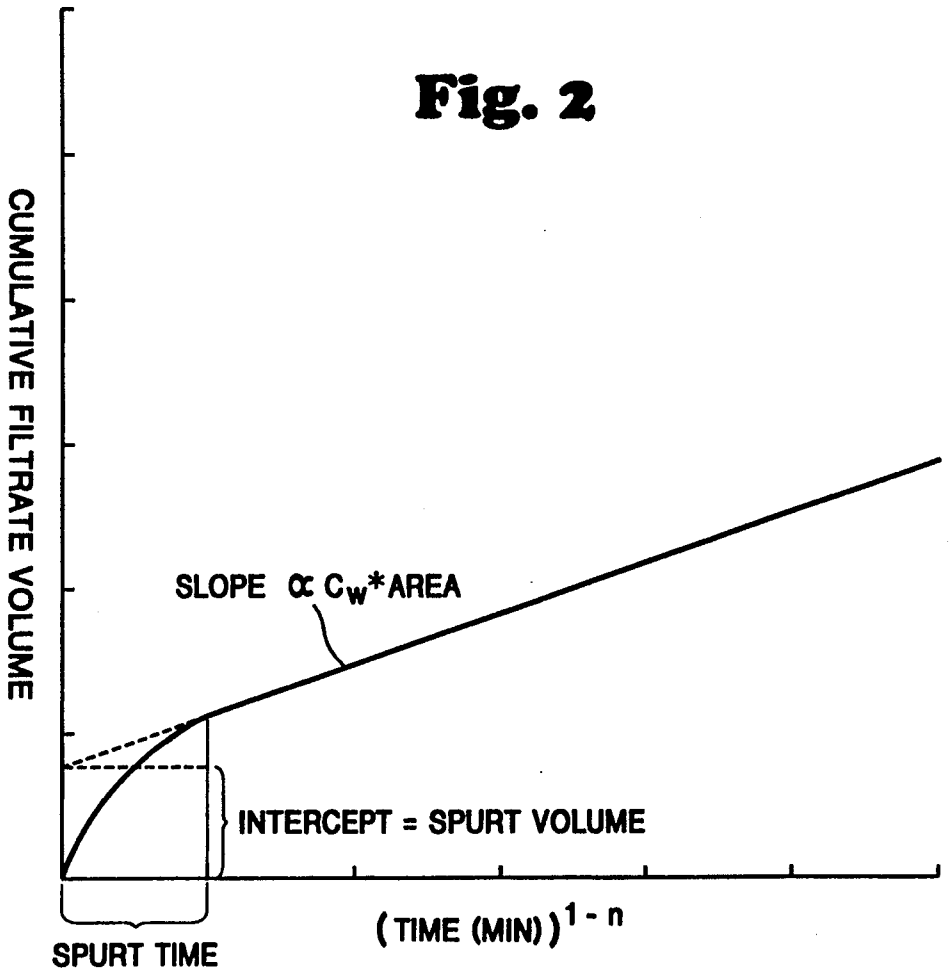
FIG. 2 is a plot of Cumulative Volume versus Time and shows both Spurt-Volume and Spurt-Time.

Methods in accordance with the present invention respond to the observed failure of conventional minifrac analysis in predicting the fluid-loss behavior of naturally fractured formations. This failure lies in the assumption of formation homogeneity implicit in its formulation. By treating fluid-loss rate as being inversely proportional to the square root of contact time, conventional analysis techniques assume not only formation homogeneity, but filter cake incompressibility and proportionality between filter cake deposition and volume lost. Under dynamic conditions, filter cake controlled fluid-loss volume is often not proportional to the square root of time, implying that filter cake growth is not proportional to the volume of fluid lost.

As discussed above, conventional minifrac analysis assumes that fracturing fluid leakoff coefficient is inversely proportional to the square root of contact time, i.e., $C_{eff} \propto 1/(\Delta t)^{0.5}$. Such a relationship indicates that the formation is assumed to be homogeneous, that back pressure in the formation ideally builds up with time thus resisting flow into the formation, and that a filter cake, if present, may be building up with time. However, the observation has been made that when the formation is heterogeneous, or naturally fractured, the leakoff rate as a function of time may follow a much different relationship.

If the conductivity of the natural fracture is extremely high, the effect of a back pressure in the formation will be insignificant during the minifrac test. Under this circumstance, the exponent of contact time, $(\Delta t)^n$, would be expected to be close to 0.0, which indicates that leakoff rate per unit area of the fracture face is nearly constant. If, however, an efficient filter cake is formed by the fracturing fluid, the time exponent may approach 0.5 or even be greater than 0.5. As known to those skilled in the art, not all fracturing fluids leakoff at the same rate in the same reservoir. Depending on the reservoirs geological characteristics, a water-based, hydrocarbon base, or foam fracturing fluid may be required. Each of these fluids have different leakoff characteristics. The amount of leakoff can also be controlled to a certain extent with the addition of various additives to the fluid.

Accordingly, depending on the degree of reservoir heterogeneity and fracturing fluid behavior, the leak-off exponent can range between 0.0 and 1.0. When pressure data are collected from a formation which is heterogeneous, or when the formation/fluid system yields $n \neq 0.5$, those data 10 will have a poor or no match with the conventional type curves because fluid leakoff is not inversely proportional to the square root of contact time. The present invention provides a method of generating new type curves which are applicable to all types of formations including naturally fractured formations and a new parameter, the leakoff exponent, that characterizes the fluid/formation leakoff relation.

In developing the present invention, the following general assumptions have been made: (1) the fracturing fluid is injected at a constant rate during the minifrac test; (2) the fracture closes without significant interference from the proppant; and (3) the formation is heterogeneous such that back pressure resistance to flow may deviate from established theory. Using the above assumptions and equations developed from minifrac tests, new type curves for pressure decline analysis for heterogeneous formations have been developed. The minifrac analysis techniques disclosed and claimed herein are suitable for application with well known fracture geometry models, such as the Khristianovic-Zheltov (KZ) model, the Perkins-Kern (PK) model, and the radial fracture (RADIAL) model as well as modified versions of the models.

The equation describing the type curves may be written as:

$$\Delta P = P^* G(\delta, \delta_o, n)$$

Assuming that n is known, the above equation indicates that a plot of logarithm of $\Delta P$ versus logarithm of $G(\delta, \delta_o, n)$ should yield a straight line with unit slope and intercept of $P^*$. Thus, only one straight line is plotted regardless of the value of dimensionless reference time. If n is not known and the wrong value is used to generate the logarithm of $\Delta P$ versus logarithm of G plot, separate lines (or curves) will be generated for various dimensionless reference times. The degree of separation depends on the error in the value of n. Thus, to determine the leakoff exponent for field data, logarithm of $\Delta P$ is plotted versus logarithm of G for various n values and $\delta_o$. The leakoff exponent n that produces the least separation is the value that most appropriately describes the formation/fluid system.

Another embodiment involves a derivative technique. Such a method does not presently have a distinct advantage over the first technique; however, with the advancement of electronic gauges, use of derivatives may improve the chances of reaching a unique match.

In this derivative technique, the type curve is the plot of logarithm of either $(\partial G/\partial \delta)$ or $\delta(\partial G/\partial \delta)$ versus logarithm of dimensionless time, $\delta$. Field data are plotted as logarithm of either $(\partial \Delta P/\partial \delta)$ or $\delta(\partial \Delta P/\partial \delta)$ versus logarithm of dimensionless time, $\delta$. Matching is performed similarly to the conventional method yielding $P^*$. Also, logarithm of $(\partial \Delta P/\partial \delta)$ may be plotted versus logarithm of $(\partial G/\partial \delta)$ for various n and $\delta_o$ values. The n value that produces the least separation between lines representing the various $\delta_o$ values is the leakoff exponent that most appropriately describes the fluid/formation system.

Another embodiment to determine leakoff exponent that is more direct is another modified derivative technique. The dimensionless pressure decline may be expanded using Taylor series to give:

$$G(\delta, \delta_o, n) = \frac{4}{\pi(1-n)(2-n)} [c + (2-n)\,\delta^{1-n} - (1+\delta_o)^{2-n} + \delta_o^{2-n}]$$

The dimensionless pressure drop is defined as:

$$G(\delta, \delta_o, n) = \frac{\Delta P}{P^*}$$

Substituting, and then taking the derivative of $\Delta P$ with respect to dimensionless time yields:

$$\frac{\partial \Delta P}{\partial \delta} = \frac{4P^*}{\pi} \delta^{-n}$$

Multiplying this result by dimensionless time and then taking the logarithm of the resulting equation yields:

$$\log \delta \left( \frac{\partial \Delta P}{\partial \delta} \right) = \log \left( \frac{4P^*}{\pi} \right) + (1 - n) \log \delta$$

Plotting the logarithm of $\delta(\partial \Delta P/\partial \delta)$ versus logarithm of dimensionless time should yield a straight line whose slope is $(1-n)$ and intercept is $4P^*/\pi$. Thus, the leakoff exponent may be directly determined from this plot.

It is also possible to use $$\frac{\partial \Delta P}{\partial \delta} = \frac{4P^*}{\pi} \delta^{-n}$$

directly by taking the logarithm, which yields:

$$\log \left( \frac{\partial \Delta P}{\partial \delta} \right) = \log \left( \frac{4P^*}{\pi} \right) - n \log \delta$$

Plotting the logarithm of $$\frac{\partial \Delta P}{\partial \delta}$$

versus logarithm of versus logarithm of dimensionless time should yield a straight line whose slope is $-n$ and intercept is $4P^*/\pi$.

A leakoff exponent less than 0.5 indicates that the fluid-loss rate is not decreasing as rapidly as would be predicted by classical theory ($n=0.5$), such as would be the case when erosion inhibits filter cake growth. Although dual porosity systems (naturally fractured formations) may not allow the build-up of an efficient filter cake, the leakoff exponent may end up being greater than 0.5. This is because most of the fluid- loss occurs during an initial spurt period, causing the pressurization of fluid in the fracture part of the dual porosity system. This is followed by a rapidly declining fluid- loss rate. This behavior is similar to the wellbore storage effect seen in well testing. Thus, most of the fluid- loss occurs as virgin formation is exposed to fracturing fluid. During the shut-in period, the leakoff rate decreases rapidly, resulting in an exponent larger than 0.5.

The design of an efficient fracturing fluid requires knowing the leakoff exponent and having the ability to modify it. This may require the study of various parameters fundamentally affecting fluid- loss such as pore size distribution of formation rock, formation permeability, type of fluid-loss additive, type of gelling agent, and pressure drop across filter cake.

Figure 1:
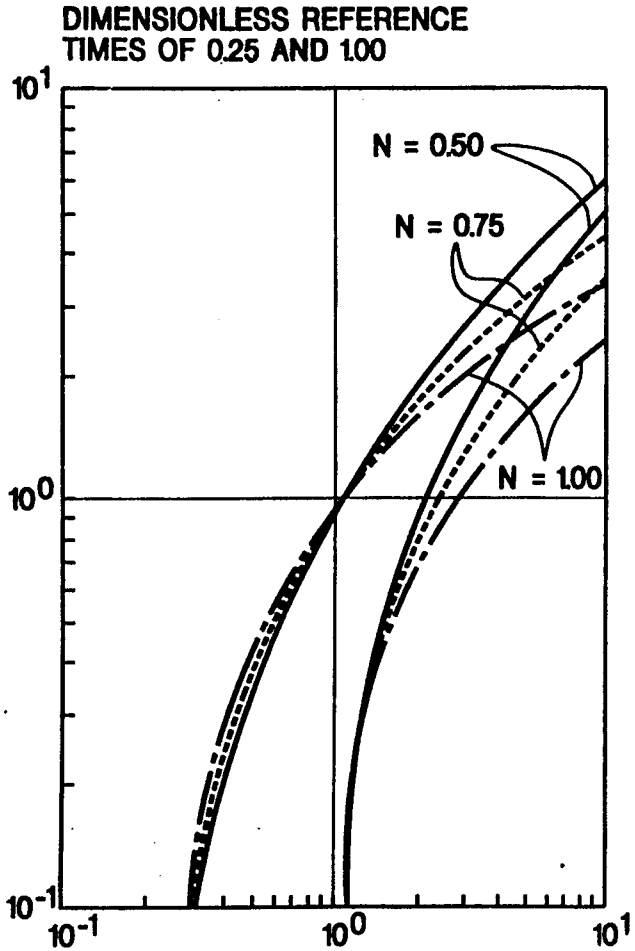
FIG. 1 is a comparison of Type Curves for the general minifrac analysis.

A minifrac analysis for the general case, as discussed above, where the leakoff exponent, n, differs from 0.5 was disclosed and claimed by the inventor in U.S. Application Ser. No. 522,427, filed May 11, 1990 by M. Y. Soliman, R. D. Kuhlman, and D. K. Poulsen, assigned to Halliburton Company. That application is incorporated by reference as if fully set forth herein. FIG. 1 compares the matching type curves developed by that analysis for different values of the leakoff coefficient, n, versus dimensionless time, $\delta_o$.

Spurt- loss takes place in the very short period following the initial contact between the fracturing fluid and previously unexposed formation. The duration and volume of this initial fluid- loss defines spurt- loss. The effect of this spurt- loss on minifrac analysis depends on spurt-time, spurt-volume and duration of the minifrac test.

Leakoff volume as a function of time behaves as shown in FIG. 2. Noticeably, there is an early, high leakoff rate lasting a short period, usually named spurt-time, followed by a more stable leakoff rate. Conventional analysis considers leakoff volume as a function of the square root of time; however, leakoff volume is better considered as a general power function of time, i.e., $t^{1-n}$, as shown in FIG. 2. Under these conditions, the straight line intercept will yield spurt-volume. It must be noted that the spurt-time and volume depend on type of formation, fluid and pressure drop across the filter cake.

If it is assumed that spurt-loss is an instantaneous phenomenon, i.e., all spurt loss takes place at the time of contact, and that no fracture propagation takes place following shut-in, then all pressure decline is controlled by the leakoff coefficient and exponent. Consequently, pressure decline with time following shut-in will yield no information on spurt-loss. However, because the leakoff coefficient and exponent do not account for all fluid lost during pumping, the closure time should reveal information about the spurt-loss. In other words, closure time should be shorter than would be expected from conventional minifrac analysis. The higher the spurt-loss, the shorter the actual closure time will be.

Because spurt-loss occurs for only a short period at the initial contact time, it may be safely assumed that the decline in pressure during the shut-in period is independent of spurt-loss. Consequently, type curve matching of the data will yield no information about the spurt-loss. Spurt-loss, however, affects closure time. Consequently, both curve matching and the knowledge of closure time are necessary to fully describe fracture and fluid-loss parameters.

The leakoff coefficient can be determined from curve matching according to formation equations of the following form:

$$C_{eff} = \frac{h_f P^*}{H_p t_o^{1-n}} \beta_s M'$$

where, $C_{eff}$ is the fluid-loss coefficient; $P^*$ is the match pressure; $h_f$ is the fracture height; $H_p$ is the fluid-loss height; $t_o$ is the pump time; n is the leakoff exponent; $\beta_s$ is the ratio of average and wellbore pressure while shut-in; and $M'$ is a fracture geometry model function such that $$\begin{aligned} M' &= h_f \text{ for the PK model} \\ &= L \text{ for the KZ model} \\ &= \frac{32}{3\pi^2} r_f \text{ for the RADIAL model} \end{aligned}$$

The second relationship is:

$$\beta_s M'' = \frac{q\, t_o\, E'\, (1 - n)\, (2 - n)}{2\, P^*\, (1 + f_x)}$$

where q is the pump rate: $E'$ is the plane strain modulus; $f_o$ is a function of fluid efficiency; and $M''$ is a formation model function such that $$M' = h_f^2 L \text{ for the PK model}$$
$$= h_f L^2 \text{ for the KZ model}$$
$$= \frac{32}{3\pi} r_f^3 \text{ for the RADIAL model}$$

Fluid efficiency and $f_x$ are dependent on spurt loss. Consequently, the third relationship is:

$$f_x = \frac{C_{eff}\, t_o^{1-n} (g_c - g_o)}{Sp + C_{eff}\, t_o^{1-n}\, g_o}$$

where Sp is spurt-loss volume per unit area.

The last equation relating the four unknown parameters is the volume balance equation. The equation states that total fluid injected is equal to fluid leakoff at time of closure.

$$q\, t_o = 2\, Sp\, A_f \frac{H_p}{h_f} + 2\, C_{eff} A_f f_p\, t_o^{1-n}\, g_c$$

where $A_f$ is the cross-sectional area of fracture and $$g_o = \frac{1}{(1-n)(2-n)}$$

$$g_c = g\left(\frac{t_c}{t_o}, n\right)$$

These four equations have four unknowns: $C_{eff}$, L or $r_f$, $f_x$, and Sp. These four unknowns may be determined by a suitably programmed computer or other method of simultaneous solution as is well known in the art.

In a preferred embodiment, the pressure decline data obtained from the minifrac treatment is analyzed according to the new type equations detailed above, and as disclosed in U.S. patent application Ser. No. 522,427 incorporated by reference herein, to determine the fluid leakoff exponent, n, and the match pressure, P*. The observed closure time of the fracture is determined from field observed data as is well known in the art. The four equations above are then solved on a suitably programmed computer.

A modified technique that could combine the minifrac analysis method and fracture design approach is presented hereinafter.

Figure 3:
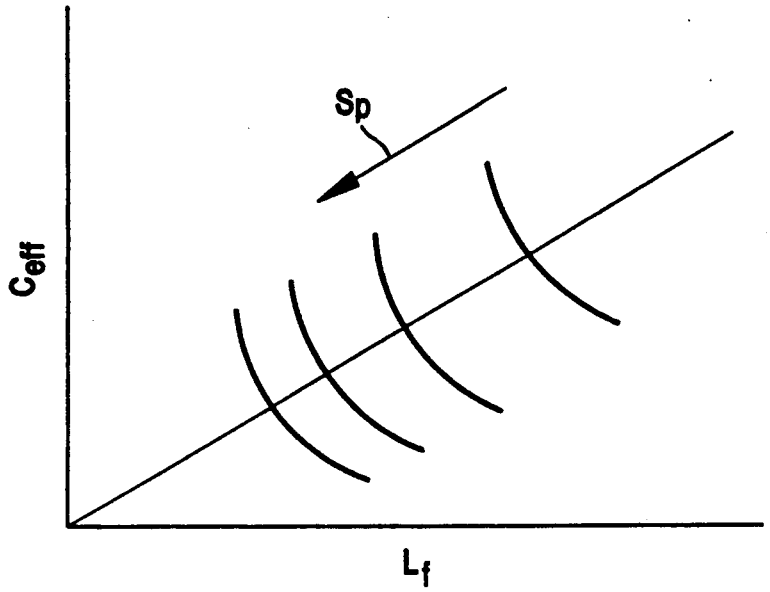
FIG. 3 is a plot of Fluid-Loss Coefficient versus Fracture Length and shows several values of Spurt-Loss.
Figure 4:
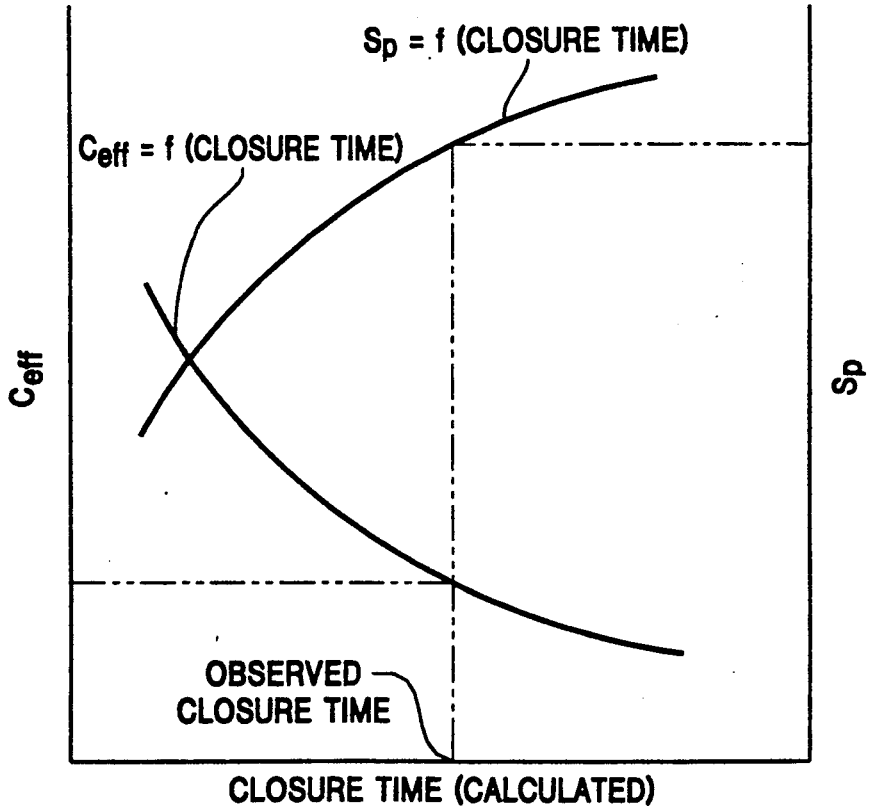
FIG. 4 is a plot of Fluid-Loss Coefficient versus Calculated Closure Time showing Spurt-Loss and Fluid-Loss Coefficient.

Several values of the leakoff coefficient are obtained for one assumed value of spurt-loss, and several values of spurt-loss are assumed. The solution should yield fracture length, $L_f$, and closure time, $t_c$. A cross plot of fluid-loss coefficient, $C_{eff}$, and fracture length, $L_f$, is constructed. (Note: fracture length, $L_f$, is used for the KZ model. For the PK model, $h_f$ would be used; for the RADIAL model), $r_f$ would be used.) The straight line described by $$C_{eff} = \frac{h_f P^*}{H_p\, t_o^{1-n}} \beta_s M'$$

is plotted on the graph along with several spurt loss curves as shown in FIG. 3. The curves are constructed using appropriate design program assuring various Sp values. The closure time is calculated using this design program utilizing the assumed spurt-loss value. The points of intersection found in FIG. 3 are plotted as leakoff coefficient, $C_{eff}$, versus closure time, $t_c$, and as spurt-loss Volume, Sp, versus closure time as shown in FIG. 4. Using the observed closure time, leakoff coefficient and spurt-loss volume are determined. These new values of leakoff coefficient and spurt-loss volume may now be used with a design program to determine fracture length, width and fluid efficiency.

If the spurt-loss is not instantaneous or nearly so, the pressure decline after shut-in will be affected by it. The extent of this effect will depend on spurt-time, spurt-volume, and pumping time. At shut-in, leakoff into the formation, at least in part of the fracture, will still be following the high rate of spurt. Thus, the leakoff calculation and the effect on pressure decline will be especially complicated. If $\delta_o$ is chosen such that all spurt-loss has taken place, pressure decline from that point on will not be affected by spurt-loss. If the method of this invention is then used, data still affected by spurt should not be considered in the analysis.

Since the leakoff rate is inversely proportional to $(\text{time})^n$ instead of square root of time, this indicates that the fracture may propagate or close at a different rate than expected.

It is noted that the calculated leakoff coefficient with exponent $=0.75$ has units of $\text{ft}/(\text{min})^{\frac{1}{4}}$, not the standard $\text{ft}/\sqrt{\text{min}}$. If the exponent is 0.0, leakoff coefficient will have units of ft/min. From analysis with exponent $n \neq 0.5$, it is possible to calculate an equivalent leakoff coefficient for $n=0.5$. This equivalent leakoff coefficient yields the same total leakoff volume during the minifrac test. Because it reaches this total volume using a different path, the leakoff volume calculated using an equivalent coefficient during a longer fracturing treatment will be different from the one calculated using actual coefficient. Even if the duration of the fracturing treatment is the same as that of a minifrac test, implying that the total leakoff volume will be the same at the end of the job, the leakoff from various stages will vary depending on exponent. Consequently, the fracturing treatment will yield created and propped fracture lengths different from those anticipated.

Figure 5:
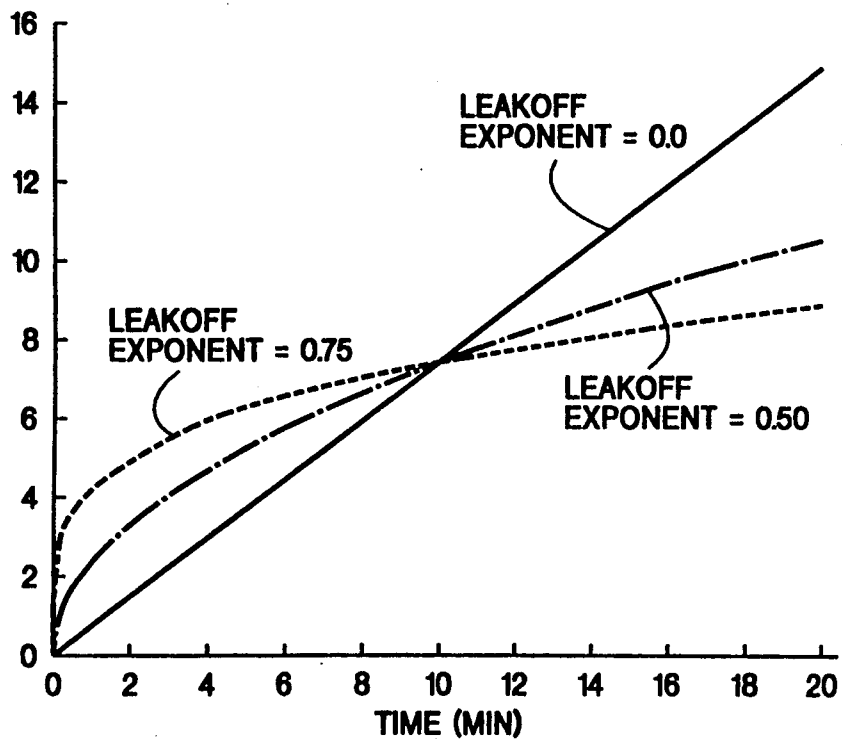
FIG. 5 is a plot of Leakoff Volume versus Time.

FIG. 5 shows the path leakoff volume would take, using equations with exponents of 0.0, 0.50, and 0.75. It is obvious that although the total leakoff volume using any of the coefficients will be the same at the end of the minifrac test (10 min.), the path each will take will be different. Thus, applying a leakoff coefficient calculated using an incorrect n value to a larger job may lead to a poorly designed treatment.

Consequently, the calculation of an equivalent leakoff coefficient is not recommended. Instead, fracture design simulators should be modified to accept a leakoff coefficient with unconventional units $(\text{ft}/(\text{min})^{1-n})$.

When a fracture closes, it is expected that pressure decline with time should deviate from the type curves developed for analysis of minifrac data. The general equation for type curves is:

$$G(\delta, \delta_o, n) = \frac{4}{\pi}\left[g(\delta, n) - g(\delta_o, n)\right]$$

where $$g(\delta, n) = \frac{1}{(1-n)(2-n)}\left[(1+\delta)^{2-n} - \delta^{2-n} + 1\right]$$

which may be expanded using a Taylor series and then approximated for n close to zero by the following equation:

$$g(\delta, n) \simeq \frac{1}{(1-n)(2-n)} [(2-n)\delta^{1-n} + c]$$

where c is a constant larger than 1.0. Strictly speaking, c is not a constant; however, over the fairly narrow range of application, c may be considered constant.

This approximation indicates that a plot of pressure versus $t^{(1-n)}$ should yield a straight line. Deviation from the straight line occurs at closure. Thus, plotting pressure versus $(\text{time})^{1-n}$ should yield a straight line before fracture closure. Deviation from this straight line indicates fracture closure. A derivative plot such as the one described in U.S. patent application Ser. No. 522,427 may also be used.

The following example serves to illustrate, but by no means to limit, the invention.

FIELD EXAMPLE

This minifrac injection test was performed on a 30 ft interval. The formation was fractured with 12,600 gal of 40 lb/1000 gal gel injected at 16.5 BPM. Radioactive tracer logs showed that the gross fracture height was approximately 100 ft. Using conventional analysis techniques, P* was evaluated as 234 psi, with an overall fluid-loss coefficient of 0.00147 ft/√min and fluid efficiency of 61.8%.

Figure 6:
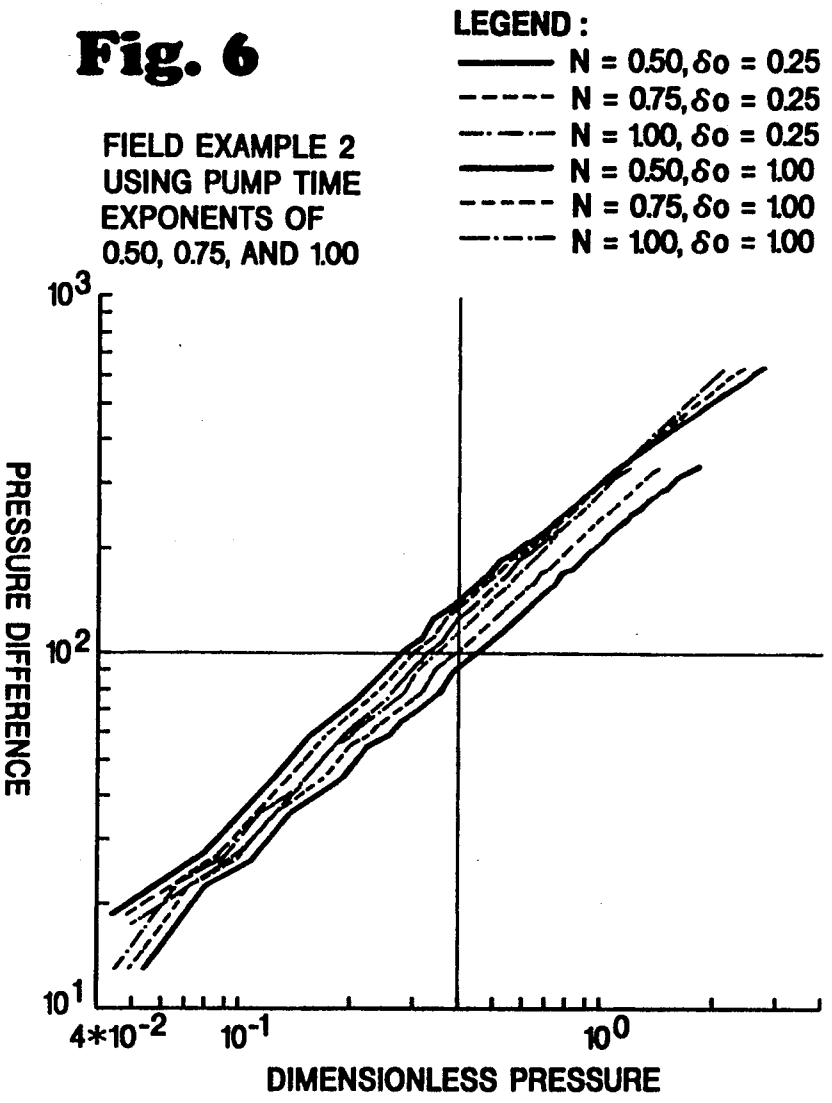
FIG. 6 is a plot of Pressure Difference versus Dimensionless Pressure.

The match of pressure difference versus dimensionless time and master curves using the new method and a leakoff exponent of 1.00 was nearly perfect. The quality of this match is verified in the plot of pressure difference versus dimensionless pressure function shown in FIG. 6. Here, the pressure difference data are plotted using dimensionless times of 0.25 and 1.00 for n=0.50, 0.75, and 1.00. The lines corresponding to dimensionless times of 0.25 and 1.00 for n=1.00 overlap and yield P* of 279.9 psi. The calculated fluid-loss coefficient is 0.0198 ft and fluid efficiency is 68%.

It is to be understood that a similar solution can be derived by those skilled in the art for n=1 in the foregoing formula whereby the fracture parameters of the subterranean formation can then be determined as described hereinbefore. Thus, it is to be understood that the present invention is not limited to the specific embodiments shown and described herein, but may be carried out in other ways without departing from the spirit or scope of the invention as hereinafter set forth in the appended claims.

What is claimed is:

1. A method for determining fracture parameters of a subterranean formation comprising the steps of:
   (a) injecting fluid into a wellbore penetrating said subterranean formation to generate a fracture in said formation;
   (b) measuring the pressure of the fluid in said fracture over time;
   (c) calculating a leakoff exponent, n, that characterizes a rate at which fluid leaks off into the formation;
   (d) determining a match pressure, P*, based on type curve matching;
   (e) determining an observed fracture closure time, $t_c$, from field data that characterizes the time in which a fracture in the subterranean formation achieves substantially zero width;
   (f) determining a spurt-loss volume per unit area, $S_p$, and fluid-loss coefficient, $C_{eff}$, from formation equations of the type;

$$C_{eff} = \frac{h_f P^*}{H_p t_o^{1-n}} \beta_s M'$$

$$\beta_s M'' = \frac{q\, t_o E' (1-n)(2-n)}{2 P^* (1 + f_x)}$$

$$f_x = \frac{C_{eff}\, t_o^{1-n} (g_c - g_o)}{Sp + C_{eff}\, t_o^{1-n} g_o}$$

$$q\, t_o = 2\, Sp\, A_f \frac{H_p}{h_f} + 2\, C_{eff} A_f f_p\, t_o^{1-n} g_c$$

2. The method of claim 1 further comprising:
   (e) determining a fracture closure pressure, $P_c$.

3. The method of claim 2 wherein the fracture closure pressure, $P_c$, is the pressure at deviation from straight line behavior of the curve formed by pressure as a power function of time, i.e., P versus $t^{(1-n)}$, according to the equation $$g(\delta, n) = \frac{1}{(1-n)(2-n)} [(2-n)\delta^{1-n} + c]$$

4. A method according to claim 1 further comprising:
   (g) utilizing the fluid-loss coefficient and spurt loss determined in step (f) to determine fracture dimensions and fluid efficiency.

5. A method of determining parameters of a fractured subterranean formation comprising the steps of
   (a) injection fluid into a wellbore penetrating said subterranean formation to generate a fracture in said formation;
   (b) measuring the pressure of the fluid in said fracture over time;
   (c) calculating a leakoff exponent, n, that characterizes a rate at which fluid leaks off into the formation;
   (d) determining a match pressure, P*, based on type curve matching;
   (e) determining an observed fracture closure time, $t_c$, from field data that characterizes the time in which a fracture in the subterranean formation achieves substantially zero width;
   (f) solving a set of formation equations for several values of spurt-loss and several values of fluid loss coefficient for fracture dimensions and closure time;
   (g) graphically plotting the curve described by $$C_{eff} = \frac{h_f P^*}{H_p t_o^{1-n}} \beta_s M'$$

against fluid-loss coefficient and fracture dimension;
   (h) plotting the values of spurt-loss from step (f) on the graph from step (g);
   (i) graphically plotting points of intersection established by step (h) as fluid-loss coefficient versus calculated closure time, and spurt-loss volume versus calculated closure time;

(j) determining the fluid-loss coefficient and the spurt-loss as a function of the observed closure time determined in step (e).

6. The method of claim 5 wherein the set of formation equations of step (f) is:

$$C_{eff} = \frac{h_f P^*}{H_p t_o^{1-n}} \beta_s M'$$

$$\beta_s M' = \frac{q t_o E' (1-n)(2-n)}{2 P^* (1 + f_x)}$$

$$f_x = \frac{C_{eff} t_o^{1-n} (g_c - g_o)}{Sp + C_{eff} t_o^{1-n} g_o}$$

-continued $$q t_o = 2 Sp A_f \frac{H_p}{h_f} + 2 C_{eff} A_f f_p t_o^{1-n} g_c$$

7. The method of claim 5 further comprising:

(k) determining a fracture closure pressure, $P_c$, as the pressure at deviation from straight line behavior of the curve formed by pressure as a power function of time, i.e., P versus $t^{1-n}$), according to the equation:

$$g(\delta, n) = \frac{1}{(1-n)(2-n)} [(2-n)\delta^{1-n} + c]$$

8. A method according to claim 5 further comprising:

(k) utilizing the fluid-loss coefficient and spurt loss determined in step (j) to determine fracture dimensions and fluid efficiency.

* * * * *